US011248283B2

(12) United States Patent
Egashira et al.

(10) Patent No.: US 11,248,283 B2
(45) Date of Patent: Feb. 15, 2022

(54) STEEL MATERIAL FOR SOFT MAGNETIC PART, SOFT MAGNETIC PART, AND METHOD FOR PRODUCING SOFT MAGNETIC PART

(71) Applicant: Nippon Steel Corporation, Tokyo (JP)

(72) Inventors: Makoto Egashira, Tokyo (JP); Hidekazu Sueno, Tokyo (JP); Hitoshi Matsumoto, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 214 days.

(21) Appl. No.: 16/463,172

(22) PCT Filed: Dec. 7, 2017

(86) PCT No.: PCT/JP2017/044037

§ 371 (c)(1),
(2) Date: May 22, 2019

(87) PCT Pub. No.: WO2018/105698

PCT Pub. Date: Jun. 14, 2018

(65) Prior Publication Data

US 2019/0330722 A1 Oct. 31, 2019

(30) Foreign Application Priority Data

Dec. 8, 2016 (JP) ..... JP2016-238390

(51) Int. Cl.
*C22C 38/28* (2006.01)
*C21D 1/04* (2006.01)
(Continued)

(52) U.S. Cl.
CPC ..... *C22C 38/28* (2013.01); *C21D 1/04* (2013.01); *C21D 8/12* (2013.01); *C22C 38/001* (2013.01);
(Continued)

(58) Field of Classification Search
CPC ..... C21D 1/04; C22C 38/28
(Continued)

(56) References Cited

U.S. PATENT DOCUMENTS

2007/0034300 A1* 2/2007 Chiba ..... C22C 38/04 148/306

FOREIGN PATENT DOCUMENTS

JP 2006-328461 A 12/2006
JP 2006-328462 A 12/2006
(Continued)

OTHER PUBLICATIONS

Translation WO-2011023349-A1 (Year: 2011).*
(Continued)

*Primary Examiner* — Stefanie J Cohen
*Assistant Examiner* — Danielle Carda
(74) *Attorney, Agent, or Firm* — Banner & Witcoff, Ltd.

(57) ABSTRACT

The steel material for a soft magnetic part according to the present invention has a chemical composition consisting of, in mass %, C: 0.02 to 0.13%, Si: 0.005 to 0.50%, Mn: 0.10 to 0.70%, P: 0.035% or less, S: 0.050% or less, Al: 0.005 to 1.300%, V: 0.02 to 0.50%, and N: 0.003 to 0.030%, with the balance being Fe and impurities. The average grain diameter of ferrite grains in the steel material for a soft magnetic part ranges from 5 to 200 μm. Further, in the ferrite grains, the number Sv (number/mm$^2$) of precipitates having a circle-equivalent diameter of 30 nm or more satisfies Formula (1):

$$Sv \leq 10V \times 7.0 \times 10^6 \quad (1)$$

where the V content (mass %) in the steel material for a soft magnetic part is substituted into V in Formula (1).

17 Claims, 2 Drawing Sheets

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/26*** | (2006.01) |
| ***C22C 38/32*** | (2006.01) |
| ***H01F 1/147*** | (2006.01) |

(52) U.S. Cl.
CPC ..... *C22C 38/02* (2013.01); *C22C 38/04* (2013.01); *C22C 38/06* (2013.01); *C22C 38/24* (2013.01); *C22C 38/26* (2013.01); *C22C 38/32* (2013.01); *H01F 1/147* (2013.01); *C22C 2202/02* (2013.01)

(58) Field of Classification Search
USPC ..... 148/309
See application file for complete search history.

(56) References Cited

FOREIGN PATENT DOCUMENTS

| | | | | | |
|---|---|---|---|---|---|
| JP | 2008-045182 | A | | 2/2008 | |
| JP | 2016180146 | A | * | 10/2016 | |
| WO | WO-2011023349 | A1 | * | 3/2011 | ..... C22C 38/60 |

OTHER PUBLICATIONS

Translation JP-2016180146-A (Year: 2016).*
English Abstract of JP2008-045182.
English Abstract of JP2006-328461.
English Abstract of JP2006-328462.

* cited by examiner

STEEL MATERIAL FOR SOFT MAGNETIC PART, SOFT MAGNETIC PART, AND METHOD FOR PRODUCING SOFT MAGNETIC PART

TECHNICAL FIELD

The present invention relates to a steel material for a soft magnetic part, a soft magnetic part using the steel material for a soft magnetic part, and a method for producing the soft magnetic part.

BACKGROUND ART

A steel material for a soft magnetic part is used as a core material of an electrical part, such as a motor and a generator. The steel material for a soft magnetic part is, for example, soft iron, pure iron, and silicon steel. In the present specification, a part using the steel material for a soft magnetic part is called a soft magnetic part.

In recent years, the shape of a soft magnetic part is increasingly complicated. With the complication of the shape, a soft magnetic part has recently been produced by performing cold working on a steel material for a soft magnetic part, such as a steel bar. In this case, a low-carbon steel material having a carbon content of about 0.1% or less is, for example, used as the steel material for a soft magnetic part. Cold working, such as wire drawing, cold forging, and cold drawing, is performed on such a low-carbon steel material to produce a soft magnetic part. The steel material for a soft magnetic part, such as a steel bar, on which cold working is performed therefore requires high cold workability.

The cold working described above, however, degrades the magnetic characteristics of the steel material for a soft magnetic part. To avoid the degradation, magnetic annealing is performed on the steel material for a soft magnetic part after the cold working. The magnetic annealing restores the magnetic characteristics degraded by the cold working.

Steel materials for a soft magnetic part for improvement in the magnetic characteristics and/or cold workability have been proposed in Japanese Patent Application Publication No. 2008-045182 (Patent Literature 1), Japanese Patent Application Publication No. 2006-328461 (Patent Literature 2), and Japanese Patent Application Publication No. 2006-328462 (Patent Literature 3).

The soft magnetic steel material disclosed in Patent Literature 1 consists of C: 0.005 to 0.05%, Si: 1.8 to 3.0%, Mn: 0.20 to 0.8%, P: 0.02% or less (excluding 0%), S: 0.02 to 0.1%, Cu: 0.1% or less (excluding 0%), Ni: 0.2% or less (excluding 0%), Cr: 1 to 3.5%, Al: 0.05 to 2.8%, N: 0.004% or less (excluding 0%), and O: 0.02% or less (excluding 0%), with the balance being Fe and inevitable impurities, and an F1 value calculated by the following expression is 60 or more: $F1=97.0C+10.9Si+4.2Mn+23.8P+172.0S+15.0Cu-0.03Ni+5.1Cr+8.6Al+34.0N+8.38$ (the symbols each represent the mass % of the corresponding element). Patent Literature 1 describes that the soft magnetic steel material allows a soft magnetic part showing a high AC magnetic flux density to be produced and satisfactory cold forgeability to be maintained.

The soft magnetic steel material disclosed in Patent Literature 2 consists of, in mass %, C: 0.015% or less, Si: 0.005 to 0.30%, Mn: 0.1 to 0.5%, P: 0.02% or less, S: 0.02% or less, Al: more than 0.010 to 1.3%, N: 0.010% or less, and O (oxygen): 0.020% or less, with the balance being Fe and impurities, and the following expression is satisfied: $0.85 \leq 0.8-0.57C+0.82Si+0.07Mn+0.78P-3.56S+0.82Al-1.0N \leq 2.0$ (the symbols each represent the mass % of the corresponding element). Patent Literature 2 describes that the soft magnetic steel material has good AC magnetic characteristics and high deformability.

The soft magnetic steel material disclosed in Patent Literature 3 consists of, in mass %, C: 0.015% or less, Si: 0.005 to 0.30%, Mn: 0.1 to 0.5%, P: 0.02% or less, S: 0.02% or less, Cr: 0.01 to 2.0%, Al: more than 0.010 to 1.3%, N: 0.010% or less, and O: 0.020% or less, with the balance being Fe and impurities, and the following expression is satisfied: $0.85 \leq 0.8-0.57C+0.82Si+0.07Mn+0.78P-3.56S+0.3Cr+0.82Al-1.0N \leq 2.0$ (the symbols each represent the mass % of the corresponding element). Patent Literature 3 describes that the soft magnetic steel material has excellent AC magnetic characteristics and high deformability.

CITATION LIST

Patent Literature

Patent Literature 1: Japanese Patent Application Publication No. 2008-045182

Patent Literature 2: Japanese Patent Application Publication No. 2006-328461

Patent Literature 3: Japanese Patent Application Publication No. 2006-328462

SUMMARY OF INVENTION

Technical Problem

A soft magnetic part is produced by performing cold working on a steel material for a soft magnetic part, for example, a steel bar and a wire rod, as described above. In recent years, a soft magnetic part having a complicated shape is required, as described above. In the production of such a soft magnetic part, to provide high cold workability, the strength of the steel material for a soft magnetic part is lowered to increase the cold workability. The steel material for a soft magnetic part under the cold working is then subjected to work hardening to increase the strength of the soft magnetic part.

However, if the cold working introduces strain in the steel material for a soft magnetic part, the strain degrades the magnetic characteristics. To restore the original magnetic characteristics, magnetic annealing is performed on the steel material for a soft magnetic part after the cold working. The magnetic annealing restores the magnetic characteristics of the steel material for a soft magnetic part. However, performing the magnetic annealing lowers the strength of the steel material for a soft magnetic part, resulting in a decrease in fatigue strength. The steel material for a soft magnetic part therefore requires not only cold workability and excellent magnetic characteristics after the magnetic annealing but also high fatigue strength after the magnetic annealing.

Patent Literatures 1 to 3 each consider the magnetic characteristics and deformability of the steel material for a soft magnetic part disclosed therein but do not particularly consider the fatigue strength after the magnetic annealing. Further, the steel material for a soft magnetic part disclosed in Patent Literature 1 contains a large amount of alloying elements. Sufficient cold workability is therefore not provided in some cases.

An objective of the present disclosure is to provide a steel material for a soft magnetic part having not only excellent cold workability but also excellent magnetic characteristics and high fatigue strength after magnetic annealing, a soft magnetic part using the steel material for a soft magnetic part, and a method for producing the soft magnetic part.

Solution to Problem

A steel material for a soft magnetic part according to the present disclosure has a chemical composition consisting of, in mass %, C: 0.02 to 0.13%, Si: 0.005 to 0.50%, Mn: 0.10 to 0.70%, P: 0.035% or less, S: 0.050% or less, Al: 0.005 to 1.300%, V: 0.02 to 0.50%, N: 0.003 to 0.030%, Cr: 0 to less than 0.80%, Ti: 0 to 0.20%, Nb: 0 to 0.20%, B: 0 to 0.005%, and Ca: 0 to 0.005%, with the balance being Fe and impurities. An average grain diameter of ferrite grains in the steel material for a soft magnetic part ranges from 5 to 200 μm. Further, in the ferrite grains in the steel material for a soft magnetic part, the number Sv (number/mm$^2$) of precipitates having a circle-equivalent diameter of 30 nm or more satisfies Formula (1):

$$Sv \leq 10V \times 7.0 \times 10^6 \quad (1)$$

where a V content (mass %) in the steel material for a soft magnetic part is substituted into V in Formula (1).

A soft magnetic part according to the present disclosure has a chemical composition consisting of, in mass %, C: 0.02 to 0.13%, Si: 0.005 to 0.50%, Mn: 0.10 to 0.70%, P: 0.035% or less, S: 0.050% or less, Al: 0.005 to 1.300%, V: 0.02 to 0.50%, N: 0.003 to 0.030%, Cr: 0 to less than 0.80%, Ti: 0 to 0.20%, Nb: 0 to 0.20%, B: 0 to 0.005%, and Ca: 0 to 0.005%, with the balance being Fe and impurities. Further, in ferrite grains, the number Sv (number/mm$^2$) of precipitates having a circle-equivalent diameter of 30 nm or more satisfies Formula (1). The maximum magnetic permeability of the soft magnetic part is 0.0015 N/A$^2$ or more.

$$Sv \leq 10V \times 7.0 \times 10^6 \quad (1)$$

where a V content (mass %) in the soft magnetic part is substituted into V in Formula (1).

A method for producing a soft magnetic part according to the present disclosure includes the steps of performing cold working on the steel material for a soft magnetic part described above to produce an intermediate material and performing magnetic annealing on the intermediate material.

Advantageous Effects of Invention

A steel material for a soft magnetic part according to the present disclosure has not only excellent cold workability but also excellent magnetic characteristics and high fatigue strength after magnetic annealing. A soft magnetic part according to the present disclosure has excellent magnetic characteristics and high fatigue strength. A method for producing a soft magnetic part according to the present disclosure allows production of the soft magnetic part described above.

DESCRIPTION OF EMBODIMENTS

Figure 1:
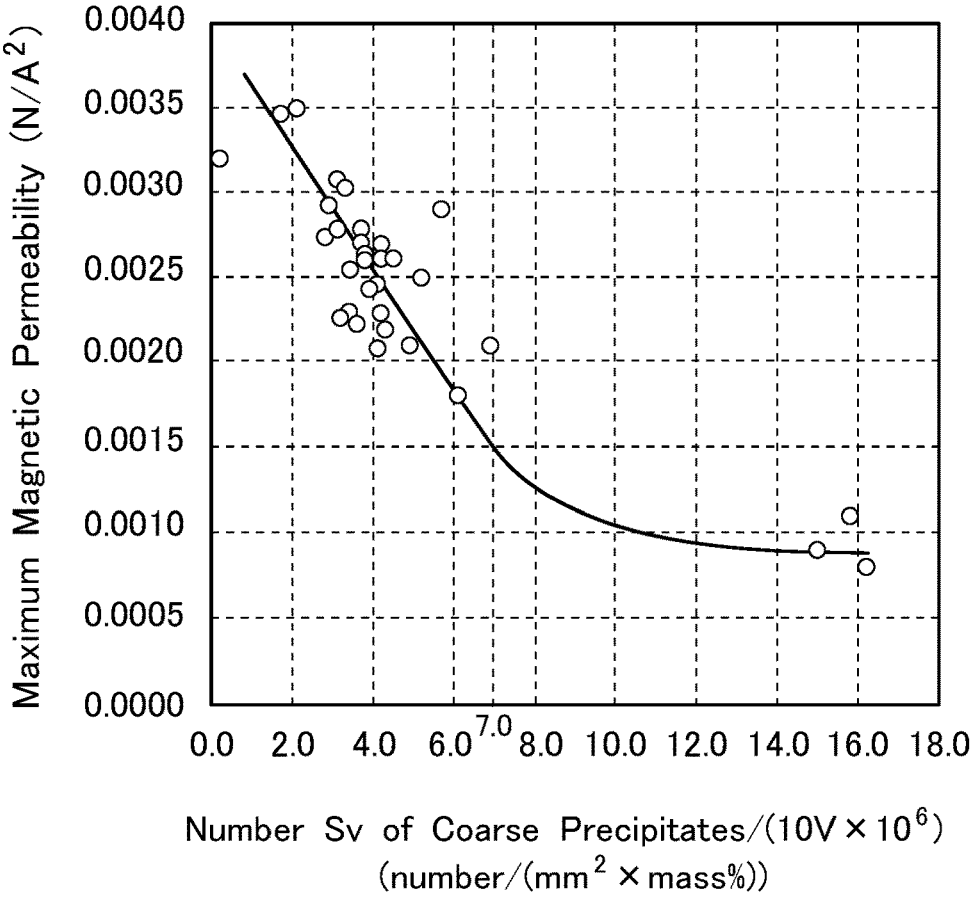
FIG. 1 shows the relationship between the number Sv (number/mm$^2$) of coarse precipitates and maximum magnetic permeability (N/A$^2$).

The present inventors have investigated and studied a steel material for a soft magnetic part having not only excellent cold workability but also excellent magnetic characteristics and high fatigue strength after magnetic annealing. As a result, the present inventors have attained the following findings:

To provide excellent cold workability, it is effective to reduce the contents of alloying elements in the steel material for a soft magnetic part, and in particular, it is effective to suppress the C content to a low value. Specifically, suppressing the C content to 0.13% or less allows improvement of the cold workability of the steel material for a soft magnetic part.

Strain introduced in a steel material for a soft magnetic part degrades the magnetic characteristics thereof. The original magnetic characteristics are restored by performing magnetic annealing to remove the strain in the steel material for a soft magnetic part. However, performing the magnetic annealing eliminates the effect of the work hardening provided by the strain and lowers the fatigue strength of the steel material for a soft magnetic part, as described above.

To increase the fatigue strength of a soft magnetic part, the strength of the steel material for a soft magnetic part may be increased. Increasing the strength of the steel material for a soft magnetic part, however, provides no excellent cold workability. That is, the strength of the steel material for a soft magnetic part is preferably low in the cold working. In view of the facts described above, the present inventors have studied a method for allowing low strength of a steel material for a soft magnetic part during the cold working but increasing the strength of the steel material for a soft magnetic part after magnetic annealing is performed on the steel material having undergone the cold working.

The magnetic annealing removes strain in the steel material for a soft magnetic part but lowers the strength thereof, as described above. The present inventors have, however, assumed that if precipitates, such as carbo-nitrides, are allowed to precipitate in the steel material for a soft magnetic part under the magnetic annealing, precipitation strengthening may increase the strength of the steel material for a soft magnetic part in compensation for the decrease in the strength resulting from the removal of the strain.

The precipitates, such as carbo-nitrides, however, degrade the magnetic characteristics of the steel material in some cases. The present inventors have conducted further study on a carbo-nitride capable of increasing the strength of the steel material after the magnetic annealing with degradation in the magnetic characteristics of the steel material suppressed. As a result, the present inventors have found the following items:

(A) If V, C, and N have dissolved in the steel material before the magnetic annealing, the magnetic annealing causes a V carbo-nitride to precipitate in the form of fine particles in the steel material. Specifically, the V carbo-nitride precipitated by the magnetic annealing has a circle-equivalent diameter of less than 30 nm. Precipitation of the fine V carbo-nitride allows an increase in the strength of the steel material after the magnetic annealing based on the precipitation strengthening while suppressing degradation in the magnetic characteristics restored by the magnetic annealing. That is, using a V carbo-nitride provides excellent magnetic characteristics and high fatigue strength after the magnetic annealing.

(B) To allow magnetic annealing to precipitate a fine V carbo-nitride, it is preferable to minimize a coarse V carbo-nitride in the steel material for a soft magnetic part before the magnetic annealing. That is, each possible element that forms a V carbo-nitride (V, C, and N) preferably dissolves in the steel material for a soft magnetic part before the magnetic annealing. In the case where V, C, and N have sufficiently dissolved in the steel material for a soft magnetic part, the cold workability thereof also increases. Further, in this case, the V, C, and N having dissolved in the steel material can form a fine V carbo-nitride during the magnetic annealing.

Based on the findings described above, the present inventors have further studied the relationship between an appropriate V carbo-nitride in the steel material for a soft magnetic part before the magnetic annealing and the magnetic characteristics and fatigue strength thereof. As a result, the present inventors have attained the following findings:

In a steel material having a chemical composition consisting of, in mass %, C: 0.02 to 0.13%, Si: 0.005 to 0.50%, Mn: 0.10 to 0.70%, P: 0.035% or less, S: 0.050% or less, Al: 0.005 to 1.300%, V: 0.02 to 0.50%, N: 0.003 to 0.030%, Cr: 0 to less than 0.80%, Ti: 0 to 0.20%, Nb: 0 to 0.20%, B: 0 to 0.005%, and Ca: 0 to 0.005%, with the balance being Fe and impurities, precipitates in ferrite grains in the steel material (steel material for a soft magnetic part) before the magnetic annealing are almost entirely V carbo-nitrides. Other precipitates in the ferrite grains are primarily Nb carbo-nitrides. That is, the size of the precipitates in the ferrite grains in the steel material (steel material for a soft magnetic part) before the magnetic annealing substantially correlates to the size of the V carbo-nitrides.

Based on the findings described above, the present inventors have assumed that if the amount of coarse precipitates is small in the ferrite grains in the steel material (steel material for a soft magnetic part) before the magnetic annealing, the amount of coarse V carbo-nitrides in the ferrite grains is small, and that V, C, and N have sufficiently dissolved in the steel material before the magnetic annealing. The present inventors have further assumed in this case that fine V carbo-nitrides precipitate after the magnetic annealing to provide high fatigue strength with degradation in the magnetic characteristics suppressed.

The present inventors have further investigated and studied the relationship of the size of the precipitates in the ferrite grains in the steel material (steel material for a soft magnetic part) before the magnetic annealing with the magnetic characteristics and fatigue strength thereof after the magnetic annealing. As a result, the present inventors have found that if the number Sv (number/mm$^2$) of precipitates having a circle-equivalent diameter of 30 nm or more in the ferrite grains in the steel material for a soft magnetic part, which is the steel material before the magnetic annealing, satisfies Formula (1), the steel material for a soft magnetic part has not only excellent cold workability but also a maximum magnetic permeability of 0.0015 N/A$^2$ or more, excellent magnetic characteristics, and high fatigue strength after the magnetic annealing:

$$Sv \leq 10V \times 7.0 \times 10^6 \quad (1)$$

where the V content (mass %) in the steel material for a soft magnetic part is substituted into V in Formula (1).

In the following present specification, a precipitate having a circle-equivalent diameter of 30 nm or more in the ferrite grains in a steel material for a soft magnetic part is referred to as a "coarse precipitate." FIG. 1 shows the relationship between the number Sv (number/mm$^2$) of coarse precipitates and the maximum magnetic permeability (N/A$^2$). FIG. 1 was obtained by conducting a test in an example described later.

Referring to FIG. 1, in a case where the number Sv of coarse precipitates in the steel material for a soft magnetic part is more than $10V \times 7.0 \times 10^6$, a decrease in the number Sv of coarse precipitates does not result in a very large change in the maximum magnetic permeability. On the other hand, in a case where the number Sv of coarse precipitates is $10V \times 7.0 \times 10^6$ or less, the maximum magnetic permeability markedly increases as the number Sv of coarse precipitates decreases. That is, the graph shown in FIG. 1 shows that an inflection point is present in the vicinity of the point where the number Sv of coarse precipitates is $10V \times 7.0 \times 10^6$. When the number Sv of coarse precipitates satisfies Formula (1), the steel material for a soft magnetic part after the magnetic annealing performed at 600° C. for the holding period of 60 minutes has a maximum magnetic permeability of 0.0015 N/A$^2$ or more, which means excellent magnetic characteristics.

The ferrite grains in the steel material for a soft magnetic part according to the present embodiment have an average grain diameter ranging from 5 to 200 μm. When the average grain diameter of the ferrite grains ranges from 5 to 200 μm, not only excellent cold workability but also excellent magnetic characteristics and high fatigue strength after the magnetic annealing are obtained, provided that the other requirements are satisfied.

A steel material for a soft magnetic part according to the present embodiment attained based on the findings described above has a chemical composition consisting of, in mass %, C: 0.02 to 0.13%, Si: 0.005 to 0.50%, Mn: 0.10 to 0.70%, P: 0.035% or less, S: 0.050% or less, Al: 0.005 to 1.300%, V: 0.02 to 0.50%, N: 0.003 to 0.030%, Cr: 0 to less than 0.80%, Ti: 0 to 0.20%, Nb: 0 to 0.20%, B: 0 to 0.005%, and Ca: 0 to 0.005%, with the balance being Fe and impurities. The average grain diameter of the ferrite grains in the steel material for a soft magnetic part ranges from 5 to 200 μm. Further, in the ferrite grains, the number Sv (number/mm$^2$) of precipitates having the circle-equivalent diameter of 30 nm or more satisfies Formula (1):

$$Sv \leq 10V \times 7.0 \times 10^6 \quad (1)$$

where the V content (mass %) in the steel material for a soft magnetic part is substituted into V in Formula (1).

The chemical composition of the steel material for a soft magnetic part described above may contain Cr: 0.02 to less than 0.80%.

The chemical composition of the steel material for a soft magnetic part described above may contain one or more selected from the group consisting of Ti: 0.01 to 0.20%, Nb: 0.01 to 0.20%, and B: 0.0008 to 0.005%.

The chemical composition of the steel material for a soft magnetic part described above may contain Ca: 0.0005 to 0.005%.

A soft magnetic part according to the present embodiment has a chemical composition consisting of, in mass %, C: 0.02 to 0.13%, Si: 0.005 to 0.50%, Mn: 0.10 to 0.70%, P: 0.035% or less, S: 0.050% or less, Al: 0.005 to 1.300%, V: 0.02 to 0.50%, N: 0.003 to 0.030%, Cr: 0 to less than 0.80%, Ti: 0 to 0.20%, Nb: 0 to 0.20%, B: 0 to 0.005%, and Ca: 0 to 0.005%, with the balance being Fe and impurities. In the ferrite grains in the soft magnetic part, the number Sv (number/mm$^2$) of precipitates having the circle-equivalent diameter of 30 nm or more satisfies Formula (1). Further, the maximum magnetic permeability of the soft magnetic part is 0.0015 $N/A^2$ or more.

$$Sv \leq 10V \times 7.0 \times 10^6 \quad (1)$$

where the V content (mass %) in the soft magnetic part is substituted into V in Formula (1).

The chemical composition of the soft magnetic part described above may contain Cr: 0.02 to less than 0.80%.

The chemical composition of the soft magnetic part described above may contain one or more selected from the group consisting of Ti: 0.01 to 0.20%, Nb: 0.01 to 0.20%, and B: 0.0008 to 0.005%.

The chemical composition of the soft magnetic part described above may contain Ca: 0.0005 to 0.005%.

A method for producing a soft magnetic part according to the present embodiment includes the steps of performing cold working on the steel material for a soft magnetic part described above to produce an intermediate material and performing magnetic annealing on the intermediate material.

In the present specification, the magnetic annealing refers to a heat treatment of heating a steel material for restoration and recrystallization to reduce strain in the steel material and increase the magnetic characteristics thereof. The heating temperature is not limited to a specific value but desirably ranges from 200° C. to the $A_{c1}$ point to provide the effect described above.

The steel material for a soft magnetic part, the soft magnetic part, and the method for producing the soft magnetic part according to the present embodiment will be described below in detail. In the following description, "%" representing the content of each element means mass % unless otherwise particularly stated.

[Chemical Composition]

The chemical composition of the steel material for a soft magnetic part according to the present embodiment contains the following elements:

C: 0.02 to 0.13%

Carbon (C) bonds to V, which will be described later, after the magnetic annealing to form a V carbo-nitride, which increases the strength of the steel material. As a result, the fatigue strength of the steel material increases after the magnetic annealing. When the C content is less than 0.02%, the steel material after the magnetic annealing has insufficient strength. On the other hand, when the C content is more than 0.13%, the cold workability of the steel material for a soft magnetic part decreases. Further, when the C content is more than 0.13%, the magnetic characteristics of the steel material after the magnetic annealing are degraded. The C content therefore ranges from 0.02 to 0.13%. A preferable lower limit of the C content is 0.03%. A preferable upper limit of the C content is less than 0.10%, more preferably 0.09%.

Si: 0.005 to 0.50%

Silicon (Si) deoxidizes steel when it is melted. When the Si content is less than 0.005%, the effect described above is not provided. On the other hand, Si dissolves and strengthens ferrite. Therefore, when the Si content is more than 0.50%, the ferrite has too high strength, resulting in degradation in the cold workability of the steel material for a soft magnetic part. The Si content therefore ranges from 0.005 to 0.50%. A preferable lower limit of the Si content is 0.010%. A preferable upper limit of the Si content is 0.45%, more preferably 0.40%.

Mn: 0.10 to 0.70%

Manganese (Mn) dissolves in steel and increases the strength of the steel material. When the Mn content is less than 0.10%, the effect described above is not provided. On the other hand, when the Mn content is more than 0.70%, the ferrite has too high strength, resulting in degradation in the cold workability of the steel material for a soft magnetic part. The Mn content therefore ranges from 0.10 to 0.70%. A preferable lower limit of the Mn content is 0.20%. A preferable upper limit of the Mn content is 0.65%, more preferably 0.60%.

P: 0.035% or less

Phosphorus (P) is an impurity and is inevitably contained in a steel material. The P content is therefore more than 0%. P tends to segregate in steel and causes a decrease in local ductility. When the P content is more than 0.035%, the local ductility is likely to decrease. In this case, the cold workability of the steel material for a soft magnetic part is degraded. The P content is therefore 0.035% or less. A preferable upper limit of the P content is 0.030%, more preferably 0.025%. The P content is preferably as low as possible. The lower limit of the P content is therefore not limited to a specific value. However, when the P content is less than 0.002%, the above-mentioned decrease in local ductility is unlikely to occur. Further, in actual operation, lowering the P content to a value less than 0.002% excessively increase the production cost. A preferable lower limit of the P content is therefore 0.002%.

S: 0.050% or less

Sulfur (S) is inevitably contained in a steel material. The S content is therefore more than 0%. S bonds to Mn to form MnS, which increases the machinability of a steel material. However, when the S content is more than 0.050%, coarse MnS is produced. Since coarse MnS serves as a start point of cracking, the cold workability of the steel material for a soft magnetic part is degraded. The S content is therefore 0.050% or less. A preferable upper limit of the S content is 0.045%, more preferably 0.040%. From the viewpoint of a decrease in desulfurization cost, a preferable lower limit of the S content is 0.0001%. To effectively increase the machinability of the steel material for a soft magnetic part, a preferable lower limit of the S content is 0.005%, more preferably 0.006%.

V: 0.02% to 0.50%

Vanadium (V) forms a V carbo-nitride when magnetic annealing is performed on the steel material after the cold working. A decrease in the strength of the steel material attributable to the magnetic annealing is thus suppressed. When the V content is less than 0.02%, the effect described above is not provided. On the other hand, when the V content is more than 0.50%, the steel material for a soft magnetic part before the cold working has too high strength, resulting in degradation in the cold workability of the steel material for a soft magnetic part. Further, when the V content is more than 0.50%, the magnetic characteristics of the steel material after the magnetic annealing are degraded. The V content therefore ranges from 0.02 to 0.50%. A preferable lower limit of the V content is 0.03%, more preferably 0.04%. A preferable upper limit of the V content is 0.45%, more preferably 0.40%.

Al: 0.005 to 1.300%

Aluminum (Al) deoxidizes steel when it is melted. Al further increases electrical resistance of the steel material to increase the magnetic characteristics of the steel material. When the Al content is less than 0.005%, the effect described above is not provided. On the other hand, when the Al content is more than 1.300%, the ferrite has too high strength, resulting in degradation in the cold workability of the steel material for a soft magnetic part. The Al content therefore ranges from 0.005 to 1.300%. A preferable lower limit of the Al content for further enhancement of the deoxidization effect is 0.010%, more preferably 0.014%. A preferable upper limit of the Al content is 1.000%, more preferably 0.950%.

N: 0.003 to 0.030%

Nitrogen (N) bonds to V and C when the magnetic annealing is performed to form a V carbo-nitride. A decrease in the strength of the steel material attributable to the magnetic annealing is thus suppressed. When the N content is less than 0.003%, the effect described above is not provided. On the other hand, when the N content is more than 0.030%, the cold workability of the steel material for a soft magnetic part is degraded. The N content therefore ranges from 0.003 to 0.030%. A preferable upper limit of the N content is 0.025%, more preferably 0.020%. A preferable lower limit of the N content is 0.005%.

The balance of the chemical composition of the steel material for a soft magnetic part according to the present embodiment is Fe and impurities. The impurities used herein mean those originating from ore as raw materials, scraps, or a production environment used when the steel material for a soft magnetic part according to the present embodiment is industrially produced but those permitted to the extent that they do not markedly adversely affect the cold workability of the steel material for a soft magnetic part according to the present embodiment or the magnetic characteristics or fatigue strength of the soft magnetic part after the magnetic annealing.

The impurities may include any element excluding the elements described above. The impurities may be formed of one type or two or more types of element. In the case of the steel material for a soft magnetic part according to the present embodiment, the impurities are, for example, as follows:

O: 0.030% or less; Pb: 0.05% or less; Cu: 0.20% or less; Ni: 0.20% or less; Mo: 0.05% or less; rare earth metal (REM): 0.0003% or less; Mg: 0.003% or less; W: 0.003% or less; Sb: 0.003% or less; Bi: 0.003% or less; Co: 0.003% or less; and Ta: 0.003% or less.

These impurities may be contained in the steel material for a soft magnetic part within the ranges described above. The contents of other elements may not be particularly controlled as long as they fall within typical ranges except elements that will be described later.

The REM in the present specification refers to one or more elements selected from the group consisting of yttrium (Y) with atomic number 39, the elements from lanthanum (La) with atomic number 57 to lutetium (Lu) with atomic number 71 that are lanthanoids, and the elements from actinium (Ac) with atomic number 89 to lawrencium (Lr) with atomic number 103 that are actinoids. The REM content in the present specification is the overall content of these elements.

[Optional Elements]

The chemical composition of the steel material for a soft magnetic part according to the present embodiment may further contain Cr in lieu of part of Fe.

Cr: 0 to less than 0.80%

Chromium (Cr) is an optional element and may not be contained. That is, the Cr content may be 0%. In the case where Cr is contained, Cr dissolves in the steel material and increases the strength of the steel material. Any content of Cr provides the effect to some extent. On the other hand, when the Cr content is 0.80% or more, the ferrite has too high strength, resulting in degradation in the cold workability of the steel material for a soft magnetic part. The Cr content therefore ranges from 0 to less than 0.80%. A preferable lower limit of the Cr content for effectively providing the effect described above is more than 0%, more preferably 0.02%, still more preferably 0.03%, still more preferably 0.05%. A preferable upper limit of the Cr content is 0.75%, more preferably 0.50%.

The chemical composition of the steel material for a soft magnetic part according to the present embodiment may further contain one or more selected from the group consisting of Ti, Nb, and B in lieu of part of Fe. These elements each increase the fatigue strength of the steel material after the magnetic annealing.

Ti: 0 to 0.20%

Titanium (Ti) is an optional element and may not be contained. That is, the Ti content may be 0%. In the case where Ti is contained, Ti forms a carbo-nitride to further increase the strength and the fatigue strength of the steel material after the magnetic annealing. Any content of Ti provides the effect to some extent. However, when the Ti content is more than 0.20%, the cold workability of the steel material for a soft magnetic part is degraded. The Ti content therefore ranges from 0 to 0.20%. A preferable lower limit of the Ti content for effectively providing the effect described above is more than 0%, more preferably 0.01%, still more preferably 0.02%. A preferable upper limit of the Ti content is 0.15%, more preferably 0.13%.

Nb: 0 to 0.20%

Niobium (Nb) is an optional element and may not be contained. That is, the Nb content may be 0%. In the case where Nb is contained, Nb forms a carbo-nitride to increase the strength and the fatigue strength of the steel material after the magnetic annealing. Any content of Nb provides the effect to some extent. However, when the Nb content is more than 0.20%, the cold workability of the steel material is degraded. The Nb content therefore ranges from 0 to 0.20%. A preferable lower limit of the Nb content for effectively providing the effect described above is more than 0%, more preferably 0.01%, still more preferably 0.02%. A preferable upper limit of the Nb content is 0.15%, more preferably 0.13%.

B: 0 to 0.005%

Boron (B) is an optional element and may not be contained. That is, the B content may be 0%. In the case where B is contained, B forms a nitride to immobilize N. The decrease in the strength after the magnetic annealing due to production of a coarse nitride after hot rolling is thus suppressed. Any content of B provides the effect to some extent. When the B content is more than 0.005%, however, the effect is saturated. The B content therefore ranges from 0 to 0.005%. A preferable lower limit of the B content for effectively providing the effect described above is more than 0%, more preferably 0.0008%, still more preferably 0.0010%. A preferable upper limit of the B content is 0.002%, more preferably 0.0018%.

The chemical composition of the steel material for a soft magnetic part according to the present embodiment may further contain Ca in lieu of part of Fe.

Ca: 0 to 0.005%

Calcium (Ca) is an optional element and may not be contained. That is, the Ca content may be 0%. In the case where Ca is contained, Ca spheroidizes MnS in the steel to increase the cold workability of the steel material for a soft magnetic part. Any content of Ca provides the effect to some extent. When the Ca content is more than 0.005%, however, the effect is saturated. The Ca content therefore ranges from 0 to 0.005%. A preferable lower limit of the Ca content for effectively providing the effect described above is more than 0%, more preferably 0.0005%, still more preferably 0.0008%. A preferable upper limit of the Ca content is 0.002%.

[Microstructure of Steel Material for a Soft Magnetic Part]

The microstructure of the steel material for a soft magnetic part according to the present embodiment is composed of ferrite and a second phase. The second phase is pearlite. The pearlite also includes pseudo-pearlite. In the microstructure in the present embodiment, the primary phase is ferrite, and the overall area fraction of the ferrite grains is 80% or more.

[Average Grain Diameter of Ferrite Grains in Steel Material for a Soft Magnetic Part]

In the steel material for a soft magnetic part according to the present embodiment, the average grain diameter of the ferrite grains described above ranges from 5 to 200 μm. When the average grain diameter of the ferrite grains is less than 5 μm, movement of the magnetic domain wall is hindered, resulting in degradation in the magnetic characteristics of the soft magnetic part after the magnetic annealing. On the other hand, the average grain diameter of the ferrite grains is more than 200 μm, the fatigue strength after the magnetic annealing decreases. The average grain diameter of the ferrite grains therefore ranges from 5 to 200 μm. A preferable lower limit of the average grain diameter of the ferrite grains is 10 μm, more preferably 20 μm. A preferable upper limit of the average grain diameter of the ferrite grains is 180 μm, more preferably 150 μm.

The area fraction of the ferrite grains and the average grain diameter of the ferrite grains in the steel material for a soft magnetic part can be measured by using the following method: A sample for structure observation is taken from the steel material for a soft magnetic part. Specifically, in the case where the steel material for a soft magnetic part is a steel bar or a wire rod, a sample for observing the microstructure is collected from a central portion of a radius R, which connects the surface to the center axis of the steel bar or the wire rod, (hereinafter referred to as R/2 portion) in a cross section of the steel bar or the wire rod (surface perpendicular to longitudinal direction of the steel bar or the wire rod). Out of the sample from the R/2 portion, the surface perpendicular to the longitudinal direction of the steel material for a soft magnetic part is defined as an observation surface. After the observation surface is polished, the observation surface of the sample is etched with 3% nitric acid alcohol (nital etching reagent). The etched observation surface is observed under an optical microscope set at a magnification of 100, and arbitrary five visual fields are identified along a line separate by 1 mm from the outer circumference of the cross section. Photographic images of the identified visual fields are produced.

In each of the visual fields, the ferrite grains are identified based on the contrast. Specifically, in each of the visual fields, ferrite is observed in the form of white uniform portion, pearlite is observed in the form of a layered structure, and the grain boundary between the ferrite and the pearlite is observed in the form of black lines resulting from grain intergranular corrosion. Further, the structure other than the ferrite and the pearlite is observed in the form of a black portion. Thus, areas observed in the form of white uniform portions surrounded by the black lines in each of the visual fields are determined as the ferrite grains. The ferrite grains in each of the visual fields are identified by using the method described above.

After the ferrite grains in each of the visual fields are identified, the area of each of the ferrite grains is determined. The determined area of each of the ferrite grains is used to determine the circle-equivalent diameter of the ferrite grain. The average of the circle-equivalent diameters determined in the five visual fields is defined as the average grain diameter (μm) of the ferrite grains. Further, the ratio of the overall area of the ferrite grains in the five visual fields to the overall area of the five visual fields is defined as the area fraction (%) of the ferrite grains. In the present specification, the circle-equivalent diameter means the diameter of a circle having the area equivalent to that of a grain or a precipitate observed in a visual field plane in the structure observation.

[Number Sv of Coarse Precipitates]

Further, in the steel material for a soft magnetic part according to the present embodiment, the number Sv (number/mm$^2$) of coarse precipitates in the ferrite grains satisfies Formula (1):

$$Sv \leq 10V \times 7.0 \times 10^6 \quad (1)$$

where the V content (mass %) in the steel material for a soft magnetic part is substituted into V in Formula (1).

The coarse precipitates mean precipitates each having the circle-equivalent diameter of 30 nm or more out of the precipitates contained in the ferrite grains in the steel material for a soft magnetic part, as described above. In the present specification, the circle-equivalent diameter means the diameter of a circle having the area equivalent to that of a grain or a precipitate identified in a visual field plane in the structure observation, as described above. The upper limit of the circle-equivalent diameter of a precipitate contained in the ferrite of the steel material for a soft magnetic part according to the present embodiment is 1000 nm (1 μm). That is, in the present embodiment, the circle-equivalent diameter of a coarse precipitate ranges from 30 nm to 1000 nm.

The precipitates in the ferrite grains in the steel material for a soft magnetic part according to the present embodiment include a V carbo-nitride and a Nb carbo-nitride, as described above. In the present specification, the "carbo-nitride" is a collective name of carbides, nitrides, and carbo-nitrides. That is, a V carbo-nitride in the present specification includes not only a V carbo-nitride containing V, C, and N in a narrow sense but also a V carbide containing V and C and a V nitride containing V and N.

The precipitates contained in the ferrite grains in the steel material for a soft magnetic part according to the present embodiment originate from the elements contained as the components in the chemical composition described above. Based on the chemical composition described above, the precipitates contained in the ferrite grains in the steel material for a soft magnetic part are believed to be nearly all V carbo-nitrides. In the case where Nb, which is an optional element, is further contained, the precipitates contained in the ferrite grains in the steel material for a soft magnetic part are believed to further contain Nb carbo-nitrides.

The number Sv of coarse precipitates can be determined by using the following method: A thin film sample (having thickness of 100 nm) for observation of the structure of the ferrite region is taken from an arbitrary location of a cross section of the steel material for a soft magnetic part. In the case where the steel material for a soft magnetic part is a steel bar or a wire rod, thin film sample for structure observation is collected from the R/2 portion (a portion containing a point that bisects a distance between the center point of a cut surface (having a circular shape) of the steel bar or the wire rod and the outer circumference of the cut surface), and arbitrary five visual fields are identified in the ferrite grain portion.

The structure of each of the identified five visual fields is observed under a transmission electron microscope (TEM) set at a magnification of 40000. Specifically, photographic images of the arbitrary five visual fields (2.2 μm×1.7 μm) are produced. Image processing is performed on the photographic image of each of the visual fields to identify the precipitates in the visual field. The precipitates can be identified based on the contrast. The circle-equivalent diameter of each of the identified precipitates is determined by using image processing. Precipitates each having the circle-equivalent diameter of 30 nm or more (coarse precipitates) are identified based on the obtained circle-equivalent diameters. The total number of coarse precipitates identified in the five visual fields is determined, and the number Sv (number/$mm^2$) of coarse precipitates is determined based on the total number and the overall area of the five visual fields.

Referring to FIG. 1, when the number Sv of coarse precipitates is more than $10V\times7.0\times10^6/mm^2$, the maximum magnetic permeability after the magnetic annealing performed at 600° C. for the holding period of 60 minutes is less than 0.0015 $N/A^2$. In this case, the fatigue strength of the soft magnetic part after the magnetic annealing also decreases. The reason for this is believed to be as follows:

When the number Sv of coarse precipitates in the steel material for a soft magnetic part is more than $10V\times7.0\times10^6/mm^2$, a large number of coarse precipitates are present also in the soft magnetic part after the magnetic annealing. The coarsened V carbo-nitrides degrade the magnetic characteristics. As a result, the magnetic characteristics of the soft magnetic part after the magnetic annealing are degraded. Further, when the number Sv of coarse precipitates in the steel material for a soft magnetic part is more than $10V\times7.0\times10^6/mm^2$, V, C, or N has not dissolved sufficiently in the steel material for a soft magnetic part. In this case, V carbo-nitrides are unlikely to precipitate in the form of fine particles during the magnetic annealing. As a result, the fatigue strength of the soft magnetic part after the magnetic annealing cannot be sufficiently increased.

On the other hand, referring to FIG. 1, when the number Sv of coarse precipitates is $10V\times7.0\times10^6/mm^2$ or less, the maximum magnetic permeability after the magnetic annealing markedly increases to 0.0015 $N/A^2$ or more. When the number Sv of coarse precipitates is $10V\times7.0\times10^6/mm^2$ or less, the V carbo-nitrides have dissolved sufficiently in the steel material for a soft magnetic part. Minute V carbo-nitrides therefore precipitate during the magnetic annealing, and sufficient fatigue strength can be ensured. Further, in this case, the degradation in the magnetic characteristics of the soft magnetic part due to the coarse V carbo-nitrides can be suppressed.

The number Sv of coarse precipitates is preferably as few as possible. However, in consideration of the V content described above, the number Sv of coarse precipitates may be $1.0\times10^5/mm^2$ or more in the steel material for a soft magnetic part produced in actual operation.

[Magnetic Characteristics of Steel Material for a Soft Magnetic Part after Magnetic Annealing]

The steel material for a soft magnetic part according to the present embodiment having been held at a temperature ranging from 200° C. to the Act point for a period ranging from 30 to 180 minutes shows excellent magnetic characteristics. The excellent magnetic characteristics specifically mean that a steel material for a soft magnetic part held at a temperature ranging from 200° C. to the Act point for a period ranging from 30 to 180 minutes has a maximum magnetic permeability of 0.0015 ($N/A^2$) or more in a DC hysteresis measurement test compliant with JIS C 2504 (2000).

Figure 2:
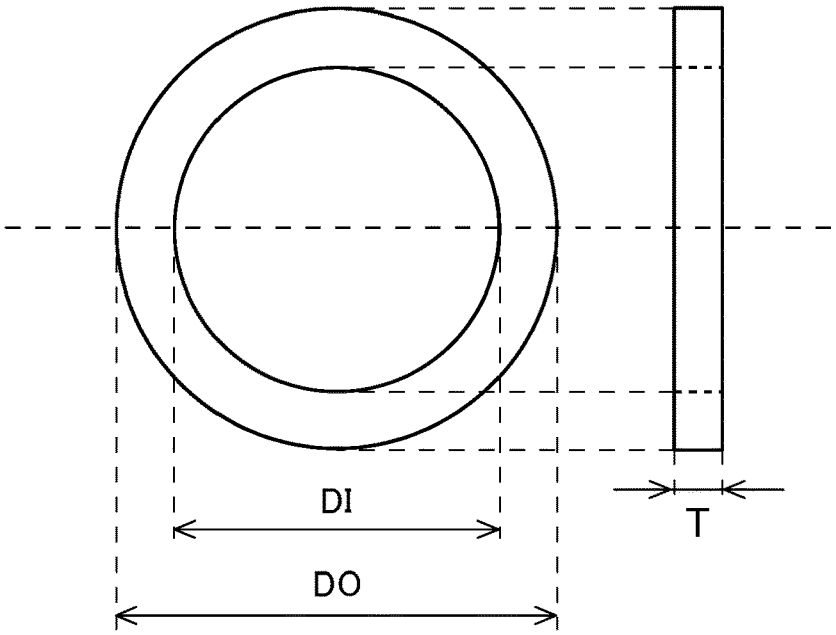
FIG. 2 is a front view and a side view of a ring-shaped test specimen created in a magnetic characteristics evaluation test in an example.

The maximum magnetic permeability of the steel material for a soft magnetic part after the magnetic annealing can be measured by using the following method: Cold working that simulates working performed on the soft magnetic part (cold upsetting, for example) is performed on the steel material for a soft magnetic part. Magnetic annealing is performed on the steel material for a soft magnetic part after the cold working at 600° C. for the holding period of 60 minutes. The steel material for a soft magnetic part having undergone the magnetic annealing is so machined that a ring-shaped test specimen shown in FIG. 2 is created. FIG. 2 is a front view and a side view of the ring-shaped test specimen. An outer diameter DO of the ring-shaped test specimen is set at a value ranging from 30 to 50 mm, and the outer diameter DO/the inner diameter DI is set at a value ranging from 1.2 to 1.4. In the case where the steel material for a soft magnetic part is a steel bar, and the outer diameter thereof is less than 30 mm, cold upsetting forging on the steel material is performed to increase the outer diameter DO to be 30 mm or more, and a ring-shaped test specimen is created in accordance with the above procedure.

The ring-shaped test specimen is used to perform the DC hysteresis measurement test in compliance with JIS C 2504 (2000). Specifically, a B-H curve up to 10000 A/m is measured, and the maximum magnetic permeability (B/H, unit: $N/A^2$) is determined.

The steel material for a soft magnetic part according to the present embodiment is, for example, a steel bar or a wire rod. In the case where the steel material for a soft magnetic part is a steel bar, the circle-equivalent diameter of a cross section perpendicular to the longitudinal direction of the steel bar ranges, for example, from 20 mm to 100 mm. The above-mentioned cross section of the steel bar may have a circular shape, a rectangular shape, or a polygonal shape.

[Soft Magnetic Part]

The steel material for a soft magnetic part according to the present embodiment is used as a soft magnetic part. The soft magnetic part is a part represented by an electrical part for an AC magnetic field, for example, in a motor, a generator, and an electromagnetic switch and is also a part characterized in that it has small coercive force and large magnetic permeability.

The soft magnetic part according to the present embodiment is provided by performing magnetic annealing on the steel material for a soft magnetic part described above having undergone cold working. That is, the chemical composition of the soft magnetic part is the same as the chemical composition of the steel material for a soft magnetic part described above. The soft magnetic part is further so configured that the number Sv of coarse precipitates in the ferrite grains satisfies Formula (1) and the maximum magnetic permeability is 0.0015 $N/A^2$ or more. The soft magnetic part according to the present embodiment is produced by using the steel material for a soft magnetic part described above and therefore has excellent magnetic characteristics and high fatigue strength.

[Production Method]

A method for producing the steel material for a soft magnetic part and the soft magnetic part according to the present embodiment described above will be described. The production method described below is an example of the method for producing the steel material for a soft magnetic part and the soft magnetic part, and the steel material for a soft magnetic part and the soft magnetic part according to the present embodiment are not necessarily produced by the production method.

[Method for Producing Steel Material for a Soft Magnetic Part]

A starting material having the chemical composition described above is prepared. The starting material is, for example, a cast piece (bloom, slab, or billet) or a steel ingot. The starting material is produced by using the following method: Molten steel having the chemical composition described above is produced. The molten steel is used to produce a cast piece by using a continuous casting process. Instead, the molten steel is used to produce an ingot by using an ingot-making process. The starting material is prepared by carrying out the steps described above.

A hot working step is carried out on the prepared starting material to produce a steel material for a soft magnetic part. In the hot working step, hot working is typically performed one or more times. Before the hot working is performed each time, the starting material is heated. The hot working is then performed on the starting material. The hot working is, for example, hot forging, hot rolling, and hot extrusion. To perform hot working multiple times, initial hot working is, for example, a coarse rolling step using blooming or hot forging, and last hot working is, for example, a finish rolling step using a continuous mill. In a hot rolling mill, a horizontal stand including a pair of horizontal rolls and a vertical stand including a pair of vertical rolls are alternately arranged in line. The steel material for a soft magnetic part produced by the hot working step described above is, for example, a steel bar or a wire rod.

The last hot working is performed, for example, at a heating temperature ranging from 1000 to 1300° C. If the heating temperature is too high, austenitic grains coarsen in some cases. In such cases, the ferrite grains provided after the hot working and cooling have too large an average grain diameter. On the other hand, if the heating temperature is too low, the austenitic grains become fine in some cases. In such cases, the ferrite grains provided after the hot working and cooling have too small an average grain diameter. The heating temperature in the last hot working therefore preferably ranges from 1000 to 1300° C.

Further, the last hot working is performed for a heating period, for example, from 30 to 120 minutes. If the heating period is too short, austenitic transformation is not adequately completed, and a duplex microstructure formed of austenite and ferrite is formed in some cases. In this case, the ferrite grains provided after the hot working and cooling have too large an average grain diameter. On the other hand, if the heating period is too long, the austenitic grains coarsen in some cases. In this case, the ferrite grains provided after the hot working and cooling have too large an average grain diameter. The heating period in the last hot working therefore preferably ranges from 30 to 120 minutes.

The last hot working is further performed, for example, at a finishing temperature ranging from 800 to 1100° C. If the finishing temperature is too low, austenitic grains become fine in some cases. In such cases, the ferrite grains provided after the hot working and cooling have too small an average grain diameter. On the other hand, if the finishing temperature is too high, the diameter of the austenitic grains coarsens due to recrystallization in some cases. In such cases, the ferrite grains provided after the hot working and cooling have too small an average grain diameter. The finishing temperature in the last hot working therefore preferably ranges from 800 to 1100° C.

The steel material for a soft magnetic part after the last hot working is cooled at a cooling rate $CR_{1000-500}$. In the present specification, the cooling rate $CR_{1000-500}$ means a cooling rate in a temperature region from 1000 to 500° C. in a case where the finishing temperature ranges from 1000 to 1100° C. Further, the cooling rate $CR_{1000-500}$ means a cooling rate in a temperature region from the finishing temperature to 500° C. in a case where the finishing temperature ranges from 800 to less than 1000° C. The cooling rate $CR_{1000-500}$ is as follows:

Cooling rate $CR_{1000-500}$: 0.10° C./second or more

The cooling rate $CR_{1000-500}$ at which the steel material for a soft magnetic part after the last hot working is cooled affects the number Sv of coarse precipitates in the steel material for a soft magnetic part. When the cooling rate $CR_{1000-500}$ is less than 0.10° C./second, the V carbo-nitrides that precipitate in the steel material during the cooling coarsen. The number Sv of precipitates each having the circle-equivalent diameter of 30 nm or more (number of coarse precipitates) is therefore more than $10V \times 7.0 \times 10^6/mm^2$. Further, when the cooling rate $CR_{1000-500}$ is less than 0.10° C./second, the ferrite grains recrystallize in some cases. In such cases, the ferrite grains have too large an average grain diameter. On the other hand, when the cooling rate $CR_{1000-500}$ is 0.10° C./second or more, the precipitating V carbo-nitrides become minute. As a result, the number Sv of coarse precipitates is $10V \times 7.0 \times 10^6/mm^2$ or less.

A preferable lower limit of the cooling rate $CR_{1000-500}$ is 0.30° C./second, more preferably 0.50° C./second, still more preferably 0.80° C./second. A preferable upper limit of the cooling rate $CR_{1000-500}$ is 5.00° C./second. When the cooling rate $CR_{1000-500}$ is more than 5.00° C./second, bainite and/or martensite are produced in some cases. In such cases, the area fraction of the ferrite grains decreases. As a result, the cold workability is degraded.

The cooling rate $CR_{1000-500}$ can be determined by using the following method: The surface temperature of the steel material for a soft magnetic part after the last hot rolling is measured with a radiation thermometer. In the case where the finishing temperature ranges from 1000 to 1100° C., the period from the time when the surface temperature is 1000° C. to the time when the surface temperature is 500° C. is measured. In the case where the finishing temperature ranges from 800 to less than 1000° C., the period from the time when the surface temperature is the finishing temperature to the time when the surface temperature is 500° C. is measured. The cooling rate $CR_{1000-500}$ is determined based on the obtained period.

The steel bar or wire rod, which is the steel material for a soft magnetic part according to the present embodiment, is produced by carrying out the production steps described above. The thus produced steel material for a soft magnetic part excels in cold workability. Further, the steel material for a soft magnetic part described above has excellent magnetic characteristics also after the magnetic annealing, which will be described later.

[Method for Producing Soft Magnetic Part]

An example of the method for producing a soft magnetic part is as follows: Cold working is performed on the steel material for a soft magnetic part described above to form a part having a desired shape. The cold working is, for example, wire drawing, cold forging, and cold drawing.

Magnetic annealing is performed on the steel material for a soft magnetic part formed as a part having a desired shape. The magnetic annealing removes the strain introduced by the cold working in the steel material for a soft magnetic part and restores the magnetic characteristics thereof. The temperature of the magnetic annealing (magnetic annealing temperature) preferably ranges from 200° C. to the $A_{c1}$ point. A preferable holding period at the magnetic annealing temperature is 30 minutes or more.

When the magnetic annealing temperature is 200° C. or more, fine V carbo-nitrides sufficiently precipitate during the magnetic annealing, whereby the strength of the soft magnetic part sufficiently increases. In consideration of heat transfer to the interior of the soft magnetic part, a further preferable magnetic annealing temperature is 400° C. When the magnetic annealing temperature is the $A_{c1}$ point or less, the situation in which coarse V carbo-nitrides precipitate can be suppressed. As a result, a high-strength soft magnetic part is achieved. From the viewpoint of heat treatment strain, a further preferable upper limit of magnetic annealing temperature is 730° C.

When the holding period at the magnetic annealing temperature described above is 30 minutes or more, a sufficient amount of fine V carbo-nitrides precipitate. A soft magnetic part having high fatigue strength is therefore provided. A long holding period also provides the effect described above. Too long a holding period, however, increases the production cost. A preferable upper limit of the holding period is therefore 180 minutes.

A soft magnetic part is produced by carrying out the production steps described above. The soft magnetic part according to the present embodiment excels in the magnetic characteristics and further has high fatigue strength.

EXAMPLE

The steel material for a soft magnetic part and the soft magnetic part according to the present embodiment will be described below in the form of an example. The steel material for a soft magnetic part and the soft magnetic part according to the present embodiment are not limited to those in the present example. The present example is an example of the steel material for a soft magnetic part and the soft magnetic part according to the present embodiment.

[Production of Steel Material for a Soft Magnetic Part]

Steel having chemical components shown in Table 1 was melted in a vacuum melting furnace. The produced molten steel was used to produce a 150 kg ingot by using an ingot-making process.

TABLE 1

| Test | Chemical composition (Unit: mass %, balance being Fe and impurities) | | | | | | | | | | | | |
|---|---|---|---|---|---|---|---|---|---|---|---|---|---|
| number | C | Si | Mn | S | V | Al | N | P | Cr | Ti | Nb | B | Ca |
| 1 | 0.13 | 0.05 | 0.40 | 0.010 | 0.25 | 0.016 | 0.005 | 0.014 | 0.04 | — | — | — | — |
| 2 | 0.13 | 0.05 | 0.40 | 0.010 | 0.25 | 0.016 | 0.005 | 0.014 | 0.04 | — | — | — | — |
| 3 | 0.09 | 0.06 | 0.41 | 0.009 | 0.14 | 0.018 | 0.004 | 0.013 | 0.05 | — | — | — | — |
| 4 | 0.09 | 0.06 | 0.41 | 0.009 | 0.14 | 0.018 | 0.004 | 0.013 | 0.05 | — | — | — | — |
| 5 | 0.09 | 0.06 | 0.41 | 0.009 | 0.14 | 0.018 | 0.004 | 0.013 | 0.05 | — | — | — | — |
| 6 | 0.03 | 0.04 | 0.38 | 0.008 | 0.07 | 0.015 | 0.004 | 0.015 | 0.03 | — | — | — | — |
| 7 | 0.02 | 0.04 | 0.39 | 0.007 | 0.10 | 0.014 | 0.005 | 0.013 | 0.15 | — | — | — | — |
| 8 | 0.15 | 0.05 | 0.40 | 0.009 | 0.15 | 0.016 | 0.004 | 0.014 | 0.06 | — | — | — | — |
| 9 | 0.01 | 0.06 | 0.40 | 0.010 | 0.04 | 0.018 | 0.004 | 0.014 | 0.05 | — | — | — | — |
| 10 | 0.08 | 0.50 | 0.25 | 0.011 | 0.08 | 0.015 | 0.006 | 0.015 | 0.04 | — | — | — | — |
| 11 | 0.07 | 0.01 | 0.34 | 0.009 | 0.06 | 0.021 | 0.005 | 0.013 | 0.05 | — | — | — | — |
| 12 | 0.09 | 0.55 | 0.35 | 0.009 | 0.05 | 0.035 | 0.004 | 0.012 | 0.06 | — | — | — | — |
| 13 | 0.09 | 0.06 | 0.70 | 0.007 | 0.09 | 0.025 | 0.005 | 0.015 | 0.04 | — | — | — | — |
| 14 | 0.08 | 0.05 | 0.10 | 0.008 | 0.07 | 0.024 | 0.006 | 0.016 | 0.30 | — | — | — | — |
| 15 | 0.09 | 0.07 | 0.81 | 0.009 | 0.06 | 0.022 | 0.006 | 0.014 | 0.06 | — | — | — | — |
| 16 | 0.07 | 0.10 | 0.20 | 0.008 | 0.08 | 0.019 | 0.004 | 0.035 | 0.03 | — | — | — | — |
| 17 | 0.08 | 0.09 | 0.22 | 0.009 | 0.08 | 0.022 | 0.005 | 0.041 | 0.04 | — | — | — | — |
| 18 | 0.09 | 0.21 | 0.31 | 0.050 | 0.06 | 0.023 | 0.005 | 0.015 | 0.05 | — | — | — | — |
| 19 | 0.09 | 0.11 | 0.35 | 0.045 | 0.09 | 0.029 | 0.004 | 0.015 | 0.05 | — | — | — | — |
| 20 | 0.09 | 0.03 | 0.38 | 0.055 | 0.08 | 0.031 | 0.005 | 0.014 | 0.04 | — | — | — | — |
| 21 | 0.09 | 0.06 | 0.28 | 0.025 | 0.50 | 0.032 | 0.006 | 0.014 | 0.06 | — | — | — | — |
| 22 | 0.08 | 0.07 | 0.29 | 0.011 | 0.45 | 0.039 | 0.005 | 0.016 | 0.03 | — | — | — | — |
| 23 | 0.08 | 0.07 | 0.29 | 0.011 | 0.45 | 0.039 | 0.005 | 0.016 | 0.03 | — | — | — | — |
| 24 | 0.09 | 0.04 | 0.33 | 0.009 | 0.03 | 0.025 | 0.004 | 0.015 | 0.10 | — | — | — | — |
| 25 | 0.08 | 0.05 | 0.31 | 0.007 | 0.02 | 0.021 | 0.005 | 0.014 | 0.35 | — | — | — | — |
| 26 | 0.09 | 0.05 | 0.32 | 0.008 | 0.52 | 0.013 | 0.004 | 0.015 | 0.06 | — | — | — | — |
| 27 | 0.05 | 0.06 | 0.30 | 0.008 | 0.01 | 0.017 | 0.004 | 0.015 | 0.05 | — | — | — | — |
| 28 | 0.09 | 0.07 | 0.15 | 0.011 | 0.07 | 1.300 | 0.006 | 0.016 | 0.04 | — | — | — | — |
| 29 | 0.08 | 0.05 | 0.31 | 0.009 | 0.08 | 0.005 | 0.005 | 0.015 | 0.05 | — | — | — | — |
| 30 | 0.09 | 0.04 | 0.32 | 0.010 | 0.05 | 1.410 | 0.005 | 0.014 | 0.05 | — | — | — | — |
| 31 | 0.08 | 0.11 | 0.30 | 0.007 | 0.06 | 0.051 | 0.005 | 0.013 | 0.79 | — | — | — | — |
| 32 | 0.09 | 0.09 | 0.31 | 0.005 | 0.03 | 0.031 | 0.006 | 0.014 | 0.02 | — | — | — | — |
| 33 | 0.07 | 0.07 | 0.31 | 0.006 | 0.07 | 0.033 | 0.004 | 0.015 | 0.82 | — | — | — | — |
| 34 | 0.09 | 0.05 | 0.35 | 0.007 | 0.09 | 0.032 | 0.030 | 0.015 | 0.04 | — | — | — | — |
| 35 | 0.08 | 0.04 | 0.34 | 0.008 | 0.08 | 0.029 | 0.025 | 0.013 | 0.05 | — | — | — | — |
| 36 | 0.09 | 0.04 | 0.36 | 0.007 | 0.09 | 0.027 | 0.003 | 0.014 | 0.22 | — | — | — | — |
| 37 | 0.08 | 0.06 | 0.33 | 0.009 | 0.09 | 0.031 | 0.032 | 0.015 | 0.05 | — | — | — | — |
| 38 | 0.09 | 0.08 | 0.37 | 0.006 | 0.07 | 0.090 | 0.016 | 0.016 | 0.04 | 0.20 | — | — | — |
| 39 | 0.08 | 0.06 | 0.35 | 0.007 | 0.09 | 0.081 | 0.004 | 0.016 | 0.03 | — | 0.20 | — | — |
| 40 | 0.09 | 0.07 | 0.34 | 0.008 | 0.11 | 0.092 | 0.005 | 0.015 | 0.03 | — | — | 0.005 | — |
| 41 | 0.06 | 0.04 | 0.28 | 0.009 | 0.11 | 0.023 | 0.005 | 0.015 | 0.04 | — | — | — | 0.005 |
| 42 | 0.09 | 0.06 | 0.41 | 0.009 | 0.14 | 0.018 | 0.004 | 0.013 | 0.05 | — | — | — | — |
| 43 | 0.09 | 0.06 | 0.41 | 0.009 | 0.14 | 0.018 | 0.004 | 0.013 | 0.05 | — | — | — | — |
| 44 | 0.09 | 0.06 | 0.41 | 0.009 | 0.14 | 0.018 | 0.004 | 0.013 | 0.05 | — | — | — | — |
| 45 | 0.12 | 0.05 | 0.42 | 0.010 | 0.01 | 0.033 | 0.005 | 0.016 | 0.03 | — | — | — | — |
| 46 | 0.06 | 0.07 | 0.44 | 0.009 | 0.11 | 0.021 | 0.004 | 0.013 | — | — | — | — | — |
| 47 | 0.07 | 0.05 | 0.34 | 0.006 | 0.10 | 0.022 | 0.005 | 0.014 | — | — | 0.19 | — | — |

TABLE 1-continued

| Test number | Chemical composition (Unit: mass %, balance being Fe and impurities) | | | | | | | | | | | | |
|---|---|---|---|---|---|---|---|---|---|---|---|---|---|
| | C | Si | Mn | S | V | Al | N | P | Cr | Ti | Nb | B | Ca |
| 48 | 0.08 | 0.09 | 0.41 | 0.011 | 0.12 | 0.031 | 0.006 | 0.015 | — | — | — | — | 0.005 |
| 49 | 0.03 | 0.41 | 0.26 | 0.009 | 0.10 | 0.025 | 0.005 | 0.013 | — | — | — | — | — |

Ingots having test numbers excluding a test number 49 were heated at a temperature ranging from 1000 to 1300° C. for a period ranging from 30 to 120 minutes. Hot working (hot forging) was performed on the heated ingots to produce steel bars (steel materials for a soft magnetic part) having a diameter of 42 mm. The finishing temperature in the hot forging ranged from 800 to 1100° C. On the other hand, the ingot having the test number 49 was heated at 1300° C. for 120 minutes. Hot forging was performed on the heated ingot to produce a steel bar having the diameter of 42 mm. The finishing temperature in the hot forging was 1150° C. Table 2 shows the cooling rates $CR_{1000-500}$ at which the steel bars having the test numbers and produced by the hot forging were cooled.

TABLE 2

| Test number | $CR_{1000-500}$ (° C./sec) | Diameter of ferrite grains (μm) | Number Sv of coarse precipitates/10 V × $10^6$ (number/($mm^2$ × mass %)) | Cold workability | Magnetic characteristics: Maximum magnetic permeability ($N/A^2$) | Magnetic characteristics: Evaluation | Fatigue strength |
|---|---|---|---|---|---|---|---|
| 1 | 0.88 | 25 | 6.1 | G | 0.0018 | G | E |
| 2 | 0.06 | 45 | 15.8 | G | 0.0011 | NA | NA |
| 3 | 0.84 | 35 | 5.2 | E | 0.0025 | E | E |
| 4 | 0.86 | 37 | 5.2 | E | 0.0008 | NA | G |
| 5 | 0.05 | 53 | 15.0 | E | 0.0009 | NA | NA |
| 6 | 0.94 | 90 | 2.1 | E | 0.0035 | E | E |
| 7 | 0.92 | 105 | 1.7 | E | 0.0035 | E | G |
| 8 | 0.89 | 20 | 6.8 | NA | 0.0014 | NA | E |
| 9 | 0.91 | 150 | 0.2 | E | 0.0038 | E | NA |
| 10 | 0.88 | 40 | 3.4 | G | 0.0023 | G | E |
| 11 | 0.85 | 38 | 2.9 | E | 0.0029 | E | G |
| 12 | 0.92 | 42 | 3.1 | NA | 0.0023 | G | E |
| 13 | 0.93 | 43 | 3.2 | G | 0.0023 | G | E |
| 14 | 0.94 | 39 | 2.8 | E | 0.0027 | E | G |
| 15 | 0.88 | 45 | 3.6 | NA | 0.0021 | G | E |
| 16 | 0.89 | 37 | 3.1 | G | 0.0031 | E | E |
| 17 | 0.90 | 41 | 4.1 | NA | 0.0029 | E | E |
| 18 | 0.93 | 42 | 4.9 | G | 0.0021 | G | E |
| 19 | 0.89 | 39 | 4.2 | E | 0.0026 | E | E |
| 20 | 0.94 | 44 | 3.9 | NA | 0.0020 | G | E |
| 21 | 0.88 | 38 | 3.6 | G | 0.0022 | G | E |
| 22 | 0.88 | 47 | 4.1 | E | 0.0025 | E | E |
| 23 | 0.03 | 68 | 16.2 | G | 0.0008 | NA | NA |
| 24 | 0.92 | 44 | 3.8 | E | 0.0026 | E | E |
| 25 | 0.96 | 39 | 3.4 | E | 0.0025 | E | G |
| 26 | 0.84 | 42 | 9.1 | NA | 0.0011 | NA | G |
| 27 | 0.88 | 61 | 0.1 | E | 0.0033 | E | NA |
| 28 | 0.90 | 42 | 3.3 | G | 0.0030 | E | E |
| 29 | 0.89 | 38 | 3.1 | E | 0.0028 | E | E |
| 30 | 0.91 | 41 | 4.4 | NA | 0.0029 | E | E |
| 31 | 0.94 | 39 | 4.1 | G | 0.0021 | G | E |
| 32 | 0.93 | 44 | 3.7 | E | 0.0027 | E | G |
| 33 | 0.92 | 48 | 3.3 | NA | 0.0022 | G | E |
| 34 | 0.88 | 51 | 4.3 | G | 0.0022 | G | E |
| 35 | 0.87 | 49 | 4.2 | E | 0.0027 | E | E |
| 36 | 0.86 | 37 | 3.8 | E | 0.0026 | E | G |
| 37 | 0.88 | 43 | 4.1 | NA | 0.0023 | G | E |
| 38 | 0.91 | 46 | 3.9 | G | 0.0024 | G | E |
| 39 | 0.90 | 51 | 3.7 | G | 0.0028 | E | E |
| 40 | 0.87 | 37 | 4.5 | G | 0.0026 | E | E |
| 41 | 0.91 | 42 | 4.2 | E | 0.0023 | G | E |
| 42 | 3.10 | 38 | 0.2 | E | 0.0032 | E | E |
| 43 | 0.54 | 35 | 5.7 | E | 0.0029 | E | G |
| 44 | 0.12 | 41 | 6.9 | E | 0.0021 | G | G |
| 45 | 0.79 | 19 | 0.3 | E | 0.0029 | E | NA |
| 46 | 0.82 | 48 | 4.5 | G | 0.0034 | E | G |
| 47 | 0.80 | 39 | 3.9 | G | 0.0031 | E | G |
| 48 | 0.78 | 41 | 4.1 | G | 0.0029 | E | G |
| 49 | 0.88 | 220 | 5.2 | G | 0.0036 | E | NA |

[Test of Measurement of Number of Coarse Precipitates]

A thin film sample for structure observation was collected from the R/2 portion of each of the steel bars having the test numbers by using the method described above. The observation surface of each of the thin film samples was so sized as to have an area of 20 μg×15 μm and a thickness of 100 nm. Arbitrary five visual fields were identified in the ferrite grain region of each of the thin film samples. The structure of each of the visual fields (2.2 μm×1.7 μm) was observed under a transmission electron microscope (TEM) set at a magnification of 40000, and photographic images of the visual fields were produced. Image processing was performed on the photographic image of each of the visual fields to identify the precipitates in the visual field. The precipitates were successfully identified based on the contrast. The circle-equivalent diameter of each of the identified precipitates was determined by using image processing. Precipitates each having the circle-equivalent diameter of 30 nm or more (coarse precipitates) were identified based on the obtained circle-equivalent diameters. The total number of coarse precipitates identified in the five visual fields was determined, and the number Sv (number/$mm^2$) of coarse precipitates was determined based on the total number and the overall area of the five visual fields. Table 2 shows the determined number Sv of coarse precipitates in the form of the number Sv of coarse precipitates/($10V\times10^6$) (number/($mm^2$×mass %)).

[Observation of Microstructure]

Figure 3:
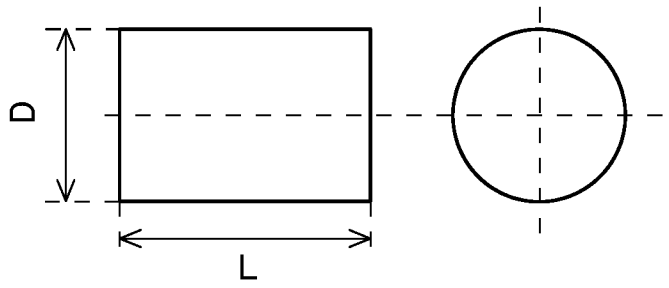
FIG. 3 is a side view and a front view of a round bar test specimen created in a cold workability evaluation test in the example.

A round bar test specimen shown in FIG. 3 was created from each of the steel bars having the test numbers. The round bar test specimens were each a test specimen having a diameter D of 14 mm around a point on the R/2 position of the steel bar having the diameter of 42 mm and a length L of 21 mm. The longitudinal direction of the round bar test specimens was parallel to the longitudinal direction of the steel bars. A sample was collected from a central portion of a cross section of each of the round bar test specimens. The ferrite grains were identified, and the average grain diameter (μm) of the ferrite grains was determined by using the method described above. Table 2 shows the determined average grain diameters of the ferrite grains. The overall area fraction of the ferrite grains was 80% or more in any of the test specimens.

[Cold Workability Evaluation Test]

Another round bar test specimen shown in FIG. 3 was created from each of the steel bars having the test numbers. The round bar test specimens were each a test specimen having the diameter D of 14 mm around a point on the R/2 position of the steel bar having the diameter of 42 mm and the length L of 21 mm. The longitudinal direction of the round bar test specimens was parallel to the longitudinal direction of the steel bars.

A cold compression test was performed on the created round bar test specimens. A 500-ton oil hydraulic press was used in the cold compression test. A plurality of the round bar test specimens were used to perform the cold compression with the compression rate (amount of compression working) incremented. Specifically, the cold compression was performed on the plurality of round bar test specimens by using an initial compression rate. After the cold compression, whether or not cracking had occurred in each of the round bar test specimens was visually checked. The cracked round bar test specimens were eliminated, and the cold compression was performed again on the remaining round bar test specimens (that is, round bar test specimens having no cracking observed) with the compression rate increased. After the compression, whether or not cracking has occurred was checked. The cracked round bar test specimens were eliminated, and the cold compression was performed again on the remaining round bar test specimens with the compression rate further increased. The compression test described above was so repeated that the steps described above were repeated until the number of cracked round bar test specimens reached half the total number of round bar test specimens.

In the compression test described above, the lowest compression rate (amount of compression working) at which the number of cracked test specimens reached 50% or more of the total number of test specimens, that is, the compression rate at which the number of cracked round bar test specimens reached half the total number of round bar test specimens was defined as a critical compression ratio (%).

In the present example, when the critical compression ratio was 75% or more, it was determined that the test specimen had excellent cold workability (labeled with "E (Excellent)" in table 2). When the critical compression ratio ranged from 65% to less than 75%, it was determined that the test specimen had good cold workability (labeled with "G (Good)" in table 2). When the critical compression ratio was less than 65%, it was determined that the test specimen had poor cold workability (labeled with "NA (Not Acceptable)" in table 2).

[Production of Soft Magnetic Part]

The test-numbered steel bars having the diameter of 42 mm were machined to create cylindrical round bar test specimens having a diameter of 30 mm. The center axis of each of the round bar test specimens was coaxial with the center axis of the corresponding steel bar. Cold upsetting was performed on the round bar test specimens having the test numbers under the same conditions to produce a plurality of intermediate materials. The upsetting ratio was 75%. Magnetic annealing was performed on the intermediate materials excluding the intermediate material having the test number 4. The magnetic annealing temperature was 600° C., and the holding period at the magnetic annealing temperature was 60 minutes. The intermediate materials after the magnetic annealing were machined to create the ring-shaped test specimens shown in FIG. 2. The ring-shaped test specimens each had an outer diameter DO of 45 mm, an inner diameter DI of 33 mm, and a thickness T of 5 mm.

[Magnetic Characteristics Evaluation Test]

The produced soft magnetic parts were used to perform the DC hysteresis measurement test in compliance with JIS C 2504 (2000). Specifically, a B-H curve up to 10000 A/m was measured, and the maximum magnetic permeability ($N/A^2$) was determined.

In the present example, when the maximum magnetic permeability p was 0.0025 $N/A^2$ or more, it was determined that the test specimen had excellent magnetic characteristics (labeled with "E" in table 2). When the maximum magnetic permeability p ranged from 0.0015 to less than 0.0025 $N/A^2$, it was determined that the test specimen had good magnetic characteristics (labeled with "G" in table 2). When the maximum magnetic permeability p was less than 0.0015 $N/A^2$, it was determined that the test specimen had poor magnetic characteristics (labeled with "NA" in table 2).

[Fatigue Strength Evaluation Test after Magnetic Annealing]

Peeling was performed on the test-numbered steel bars having the diameter of 42 mm to create round bar test specimens having a diameter of 36 mm. Cold drawing was performed on the round bar test specimens having the test numbers under the same conditions (working ratio of 75%)

to produce intermediate materials. Magnetic annealing was performed on the produced intermediate materials. The magnetic annealing temperature was 600° C., and the holding period was 60 minutes. The soft magnetic parts were produced by carrying out the steps described above.

Figure 4:
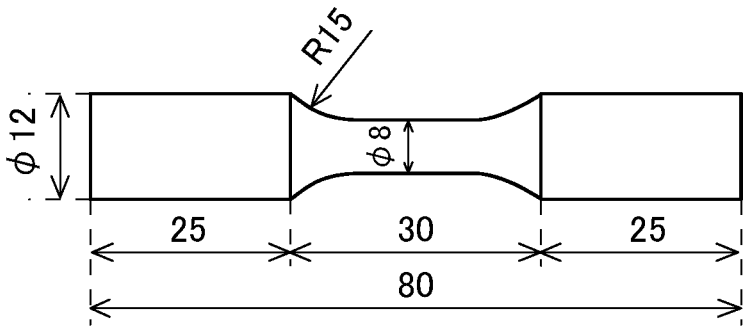
FIG. 4 is a side view of a fatigue test specimen created in a fatigue strength evaluation test after magnetic annealing in the example.

Fatigue test specimens shown in FIG. 4 were created from the produced soft magnetic parts. The numerals in FIG. 4 represent the dimensions of corresponding portions (unit: mm). The fatigue test specimens were used to perform Ono type rotating bending fatigue test. The rotating bending fatigue test was performed at a room temperature (25° C.) in the atmosphere under a reversed condition at the rotational speed of 3600 rpm. The fatigue test was so performed on each of a plurality of the fatigue test specimens that stress induced in the fatigue test specimen was changed, and the highest stress that did not cause breakage of the test specimens after $10^7$ cycles was defined as fatigue strength FS1 (MPa).

Similarly, fatigue test specimens shown in FIG. 4 were created from the round bar test specimens having the diameter of 36 mm before the cold drawing, Ono type rotating bending fatigue test was performed on the produced fatigue test specimens under the same conditions as those in the case of the soft magnetic parts, and the fatigue strength FS2 (MPa) was determined.

The ratio of the obtained fatigue strength FS1 to the obtained fatigue strength FS2 (fatigue strength ratio, unit: %) was determined from the following expression:

$$\text{Fatigue strength ratio}=FS1/FS2\times100$$

In the present example, when the obtained fatigue strength ratio was 110% or more, it was determined that the test specimen had very high strength (labeled with "E" in table 2). When the fatigue strength ratio ranged from 90 to 110%, it was determined that the test specimen had high strength (labeled with "G" in table 2). When the fatigue strength ratio was less than 90%, it was determined that the test specimen had low strength (labeled with "NA" in table 2).

[Test Results]

Table 2 shows test results. The test numbers 1, 3, 6, 7, 10, 11, 13, 14, 16, 18, 19, 21, 22, 24, 25, 28, 29, 31, 32, 34 to 36, 38 to 44, and 46 to 48 show that the chemical compositions thereof were appropriate and the methods for producing them were also appropriate. As a result, the number Sv of coarse precipitates in the steel materials for a soft magnetic part were all $10V\times7.0\times10^6/mm^2$ or less. Therefore, the steel materials having these test numbers each had excellent cold workability. Further, the soft magnetic parts having these test numbers each had a maximum magnetic permeability of 0.0015 $N/A^2$ or more and therefore had excellent magnetic characteristics after magnetic annealing. Further, the soft magnetic parts having these test numbers each had excellent fatigue strength after magnetic annealing.

Referring to the test numbers 42 to 44 having the same chemical composition, the maximum magnetic permeability increased as the cooling rate $CR_{1000-500}$ increased. Specifically, the test number 42, which was produced at the fastest cooling rate $CR_{1000-500}$, had the highest maximum magnetic permeability, and the test number 44, which was produced at the slowest cooling rate $CR_{1000-500}$, had the lowest maximum magnetic permeability. Further, the fatigue strength of the soft magnetic part having the test number 42, which was produced at the fastest cooling rate $CR_{1000-500}$, was higher than those of the soft magnetic parts having the other test numbers 43 and 44.

On the other hand, the test numbers 2, 5, and 23 show that the cooling rate $CR_{1000-500}$ after the hot working was too slow. The number Sv of coarse precipitates in each of the steel materials for a soft magnetic part was therefore more than $10V\times7.0\times10^6/mm^2$. As a result, the soft magnetic parts after the magnetic annealing each had poor magnetic characteristics and low fatigue strength.

The test number 4 underwent no magnetic annealing. As a result, the soft magnetic part had poor magnetic characteristics.

The test number 8 had too high a C content. As a result, the steel material for a soft magnetic part had poor cold workability. Further, the maximum magnetic permeability of the soft magnetic part after the magnetic annealing was less than 0.0015 $N/A^2$, resulting in poor magnetic characteristics.

The test number 9 had too low a C content. As a result, the soft magnetic part after the magnetic annealing had low fatigue strength.

The test number 12 had too high a Si content. As a result, the steel material for a soft magnetic part had poor cold workability.

The test number 15 had too high a Mn content. As a result, the steel material for a soft magnetic part had poor cold workability.

The test number 17 had too high a P content. As a result, the steel material for a soft magnetic part had poor cold workability.

The test number 20 had too high a S content. As a result, the steel material for a soft magnetic part had poor cold workability.

The test number 26 had too high a V content. The number Sv of coarse precipitates was therefore more than $10V\times7.0\times10^6/mm^2$. As a result, the steel material for a soft magnetic part had poor cold workability. Further, the maximum magnetic permeability of the soft magnetic part after the magnetic annealing was less than 0.0015 $N/A^2$, resulting in poor magnetic characteristics.

The test numbers 27 and 45 had too low a V content. As a result, the soft magnetic part after the magnetic annealing had low fatigue strength.

The test number 30 had too high an Al content. As a result, the steel material for a soft magnetic part had poor cold workability.

The test number 33 had too high a Cr content. As a result, the steel material for a soft magnetic part had poor cold workability.

The test number 37 had too high a N content. As a result, the steel material for a soft magnetic part had poor cold workability.

The test number 49 had too large an average grain diameter of the ferrite grains. As a result, the soft magnetic part after the magnetic annealing had low fatigue strength.

The embodiment of the present invention has been described. The embodiment described above is, however, merely an example of implementation of the present invention. The present invention is therefore not limited to the embodiment described above, and the embodiment described above can be changed as appropriate to the extent that the change does not depart from the substance of the present invention and implemented in the changed form.

INDUSTRIAL APPLICABILITY

The steel material for a soft magnetic part according to the present embodiment is widely useable as the material of a part that requires excellent magnetic characteristics and high strength. The steel material for a soft magnetic part according to the present embodiment is particularly suitable for an electrical part represented by a core material for an AC magnetic field, for example, in a motor, a generator, and an electromagnetic switch.

The invention claimed is:

1. A steel material for a soft magnetic part having a chemical composition consisting of, in mass %, C: 0.03 to 0.13%,
Si: 0.005 to 0.50%,
Mn: 0.10 to 0.70%,
P: 0.035% or less,
S: 0.050% or less,
Al: 0.005 to 1.300%,
V: 0.02 to 0.50%,
N: 0.003 to 0.030%,
Cr: 0 to less than 0.80%,
Ti: 0 to 0.20%,
Nb: 0 to 0.20%,
B: 0 to 0.005%, and
Ca: 0 to 0.005%, with the balance being Fe and impurities, wherein an average grain diameter of ferrite grains in the steel material for a soft magnetic part ranges from 5 to 200 μm, and in the ferrite grains, the number Sv number/mm$^2$ of precipitates having a circle-equivalent diameter of 30 nm or more satisfies Formula (1):

$$Sv \leq 10V \times 7.0 \times 10^6 \quad (1)$$

where a V content in mass % in the steel material for a soft magnetic part is substituted into V in Formula (1).

2. The steel material for a soft magnetic part according to claim 1, wherein the chemical composition contains Cr: 0.02 to less than 0.80%.

3. The steel material for a soft magnetic part according to claim 2, wherein the chemical composition contains one or more selected from a group consisting of Ti: 0.01 to 0.20%,
Nb: 0.01 to 0.20%, and
B: 0.0008 to 0.005%.

4. The steel material for a soft magnetic part according to claim 3, wherein the chemical composition contains Ca: 0.0005 to 0.005%.

5. The steel material for a soft magnetic part according to claim 2, wherein the chemical composition contains Ca: 0.0005 to 0.005%.

6. The steel material for a soft magnetic part according to claim 1, wherein the chemical composition contains one or more selected from a group consisting of Ti: 0.01 to 0.20%,
Nb: 0.01 to 0.20%, and
B: 0.0008 to 0.005%.

7. The steel material for a soft magnetic part according to claim 6, wherein the chemical composition contains Ca: 0.0005 to 0.005%.

8. The steel material for a soft magnetic part according to claim 1, wherein the chemical composition contains Ca: 0.0005 to 0.005%.

9. A soft magnetic part having a chemical composition consisting of, in mass %, C: 0.03 to 0.13%,
Si: 0.005 to 0.50%,
Mn: 0.10 to 0.70%,
P: 0.035% or less,
S: 0.050% or less,
Al: 0.005 to 1.300%,
V: 0.02 to 0.50%,
N: 0.003 to 0.030%,
Cr: 0 to less than 0.80%,
Ti: 0 to 0.20%,
Nb: 0 to 0.20%,
B: 0 to 0.005%, and
Ca: 0 to 0.005%, with the balance being Fe and impurities, wherein in ferrite grains in the soft magnetic part, the number Sv number/mm$^2$ of precipitates having a circle-equivalent diameter of 30 nm or more satisfies Formula (1), and maximum magnetic permeability is 0.0015 N/A$^2$ or more:

$$Sv \leq 10V \times 7.0 \times 10^6 \quad (1)$$

where a V content in mass % in the soft magnetic part is substituted into V in Formula (1).

10. The soft magnetic part according to claim 9, wherein the chemical composition contains Cr: 0.02 to less than 0.80%.

11. The soft magnetic part according to claim 10, wherein the chemical composition contains one or more selected from a group consisting of Ti: 0.01 to 0.20%,
Nb: 0.01 to 0.20%, and
B: 0.0008 to 0.005%.

12. The soft magnetic part according to claim 11, wherein the chemical composition contains Ca: 0.0005 to 0.005%.

13. The soft magnetic part according to claim 10, wherein the chemical composition contains Ca: 0.0005 to 0.005%.

14. The soft magnetic part according to claim 9, wherein the chemical composition contains one or more selected from a group consisting of Ti: 0.01 to 0.20%,
Nb: 0.01 to 0.20%, and
B: 0.0008 to 0.005%.

15. The soft magnetic part according to claim 14, wherein the chemical composition contains Ca: 0.0005 to 0.005%.

16. The soft magnetic part according to claim 9, wherein the chemical composition contains Ca: 0.0005 to 0.005%.

17. A method for producing a soft magnetic part comprising the steps of:

performing cold working on the steel material for a soft magnetic part according to claim 1 to produce an intermediate material; and performing magnetic annealing on the intermediate material.

* * * * *